US008021168B2

(12) United States Patent
Dandl et al.

(10) Patent No.: US 8,021,168 B2
(45) Date of Patent: Sep. 20, 2011

(54) CONTACT SPRING

(75) Inventors: Christian Dandl, Fridolfing (DE); Michael Wollitzer, Fridolfing (DE); Armin Maiwälder, Kirchanschöring (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/867,586

(22) PCT Filed: Jan. 21, 2009

(86) PCT No.: PCT/EP2009/000351

§ 371 (c)(1),
(2), (4) Date: Sep. 21, 2010

(87) PCT Pub. No.: WO2009/100807

PCT Pub. Date: Aug. 20, 2009

(65) Prior Publication Data

US 2011/0028053 A1 Feb. 3, 2011

(30) Foreign Application Priority Data

Feb. 14, 2008 (DE) ..... 20 2008 001 997 U

(51) Int. Cl.
*H01R 12/00* (2006.01)

(52) U.S. Cl. ..... 439/81

(58) Field of Classification Search ..... 439/81, 439/700, 824, 840

See application file for complete search history.

(56) References Cited

U.S. PATENT DOCUMENTS 3,138,675 A * 6/1964 Krone ..... 200/51.09
4,725,251 A * 2/1988 Neidecker et al. ..... 439/843
4,942,270 A * 7/1990 Gamarra ..... 174/93
6,274,820 B1 * 8/2001 DiStefano et al. ..... 174/254
6,595,787 B2 * 7/2003 Fork et al. ..... 439/81
6,655,964 B2 * 12/2003 Fork et al. ..... 439/55
7,093,316 B2 * 8/2006 Chen ..... 15/167.1
7,326,865 B2 * 2/2008 Ostergaard ..... 200/48 R
7,347,702 B2 * 3/2008 Eldridge et al. ..... 439/81
7,850,460 B2 * 12/2010 Weiland et al. ..... 439/66
7,927,139 B2 * 4/2011 Bernauer et al. ..... 439/589
2001/0019923 A1 * 9/2001 Moll et al. ..... 439/816
2003/0096519 A1 * 5/2003 Fork et al. ..... 439/81
2004/0097131 A1 * 5/2004 Varreng et al. ..... 439/587

(Continued)

FOREIGN PATENT DOCUMENTS

DE 323 187 C 7/1920

(Continued)

*Primary Examiner* — Tulsidas Patel
*Assistant Examiner* — Vladimir Imas
(74) *Attorney, Agent, or Firm* — DeLio & Peterson, LLC; Robert Curcio

(57) ABSTRACT

A contact spring having a free contact end for producing an electrical contact between the free contact end and a contact surface, the contact spring formed from N contact spring metal sheets and N−1 spacer elements. The contact spring metal sheets are fixed in a clamping region with a spacer element between two adjacent contact spring metal sheets, are at a distance from each other in a spring region around the thickness of the spacer elements, extend parallel to each other up to the free contact end in a freely elastic manner, and end in a common plane on the free contact end. In the spring region, the contact spring metal sheets have at least one bend with a pre-determined angle between the longitudinal axis of the contact spring metal sheets before the bend and the longitudinal axis of the contact spring metal sheets after the bend.

24 Claims, 5 Drawing Sheets

U.S. PATENT DOCUMENTS

| | | | | |
|---|---|---|---|---|
| 2005/0116799 | A1* | 6/2005 | Ostergaard | 335/132 |
| 2005/0130462 | A1* | 6/2005 | Van Schuylenbergh et al. | 439/81 |
| 2009/0156040 | A1* | 6/2009 | Bernauer et al. | 439/275 |
| 2009/0280676 | A1* | 11/2009 | Weiland et al. | 439/482 |
| 2010/0216321 | A1* | 8/2010 | Fedde et al. | 439/81 |

FOREIGN PATENT DOCUMENTS

| | | | |
|---|---|---|---|
| DE | 863 685 | C | 1/1953 |
| DE | 886 616 | B | 8/1953 |
| DE | 100 24 165 | A1 | 11/2001 |
| GB | 840 860 | A | 7/1960 |

* cited by examiner

CONTACT SPRING

CROSS REFERENCE TO RELATED APPLICATION

This application is a National Phase filing under 35 U.S.C. §371 of PCT/EP/2009/000351 which was filed Jan. 21, 2009, and claims priority to German Application No. DE 20 2008 001 997.4 filed Feb. 14, 2008.

BACKGROUND OF THE INVENTION

1. Field of the Invention

The present invention relates to a contact spring having a free contacting end for making electric contact between this free contacting end and a contact surface, the contact spring being formed by N metal contact-spring lamellae and N−1 spacer elements where N≧2, the metal contact-spring lamellae being held fixed in a clamped region with one spacer element between each two adjacent metal contact-spring lamellae, being spaced apart from one another in a resilient region, extending parallel to one another in a freely and resiliently flexing manner to the free contacting end, and ending in a common plane at the free contacting end, the metal contact-spring lamellae having, in the resilient region, at least one bend at each of which there is a predetermined angle between the longitudinal axis which the metal contact-spring lamellae have upstream of the bend and the longitudinal axis which the metal contact-spring lamellae have downstream of the bend.

2. Description of Related Art

Known from DE 886616 B is an electrical contact in which a contact part is brought into contact with a plurality of contact springs in leaf form. There are provided in this case sets of springs comprising a plurality of individual springs arranged parallel to one another which are fastened in place in a mounting. This arrangement requires a blade contact which is inserted perpendicularly to the sets of springs and which deflects the individual springs in the sets of springs perpendicularly to a longitudinal axis of the individual springs. The contact arrangement is therefore not suitable for making contact with a contact surface on a printed circuit board.

DE 100 24 165 A1, which is the generic text, relates to a contact-making system having a first contact member and a second contact member which are made from a material which flexes resiliently and is at the same time conductive. The contact members each comprise an insertable part, a resilient arm connected thereto and a contacting tip connected thereto, the resilient arm having the contacting tip at one end and the insertable part at the other end. The resilient arm is angled relative to the associated insertable part at an angle of approximately 80°. Similarly, the contacting tips are angled relative to the given resilient arm at an angle of approximately 120°. In conjunction with the resilient arm, the contacting tips serve to make contact with an electrical connection belonging to an electronic component. The two insertable parts of the contact members are arranged in a holding device with a printed circuit arranged between them. The resilient arms are spaced apart from one another in a region between the insertable parts and the contacting tips, the spacing in question being substantially less than the thickness of the printed circuit board which spaces the two insertable parts of the contact members apart from one another. This has the disadvantage that only a very small resilient travel is obtained for the resilient arms.

Known from DE 323 187 C is a fan-like electrical contact for electrical overload circuit-breakers. The fan-like contact comprises copper lamellae with highly elastic metal springs arranged between adjoining copper lamellae. These metal springs press the copper lamellae against a contact surface with a pressure which is always the same. The set of copper lamellae and metal springs is held in a central region by a clamping action. From this central region, the copper lamellae, with the springs situated between them, extend to a contacting plane with a bend and at an increasing spacing from one another.

SUMMARY OF THE INVENTION

The object underlying the invention is to improve a contact spring of the above-mentioned kind in respect of contact resistance and current transmitting capacity.

This object is achieved in accordance with the invention by a contact spring of the above-mentioned kind which has the features characterized in claim 1. Advantageous embodiments of the invention are described in the other claims.

Still other objects and advantages of the invention will in part be obvious and will in part be apparent from the specification.

The above and other objects, which will be apparent to those skilled in the art, are achieved in the present invention which is directed to a contact spring having a free contacting end for making electric contact between said free contacting end and a contact surface, the contact spring comprising N metal contact-spring lamellae and N−1 spacer elements where N≧2, the metal contact-spring lamellae being held fixed in a clamped region with one spacer element between each two adjacent metal contact-spring lamellae, being spaced apart from one another in a resilient region, extending parallel to one another in a freely and resiliently flexing manner to the free contacting end, and ending in a common plane at the free contacting end, the metal contact-spring lamellae including in the resilient region at least one bend at each of which there is a predetermined angle between an upstream longitudinal axis which the metal contact-spring lamellae have upstream of the bend and a downstream longitudinal axis which the metal contact-spring lamellae have downstream of the bend, said metal contact-spring lamellae spaced apart from one another by the thickness of the spacer elements in the resilient region and at least one of the metal contact-spring lamellae including at least one slot starting from the free contacting end.

The contact spring may include having the common plane of the free contacting end arranged to be perpendicular to the upstream longitudinal axis which the metal contact-spring lamellae and the spacer elements have in the clamped region.

The metal contact-spring lamellae may include two, three, or four bends in the resilient region. Moreover, starting from the free contacting end, all of the metal contact-spring lamellae may include at least one slot. The at least one slot may extend beyond the at least one bend in the metal contact-spring lamellae, and extend parallel to a longitudinal axis which the metal contact-spring lamellae have in the resilient region.

The metal contact-spring lamellae and the spacer elements may be riveted together, screwed together, or both riveted and screwed together in the clamped region.

The contact spring may include having the predetermined angle between the longitudinal axis which the metal contact-spring lamellae have upstream of the bend and the longitudinal axis which the metal contact-spring lamellae have downstream of the bend the same for all the bends.

Furthermore, starting from the clamped region and looking in the direction of the contacting end, the predetermined angle between the longitudinal axis which the metal contact-spring lamellae have upstream of the bend and the longitudinal axis which the metal contact-spring lamellae have downstream of the bend is more than 90° for a first bend and equal to or less than 90° for each further bend in the resilient region.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
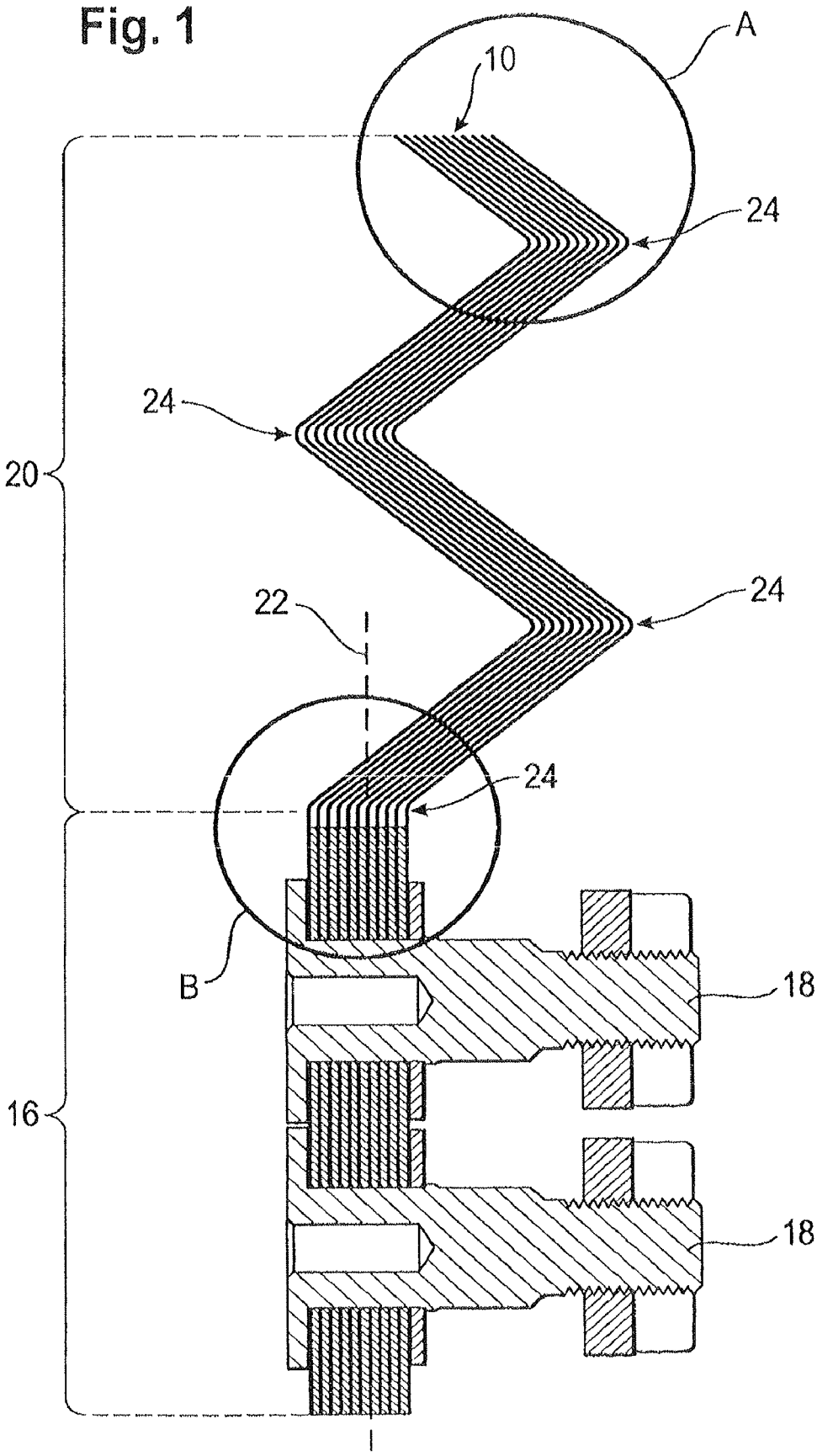
FIG. 1 is a view in section of a preferred embodiment of contact spring according to the invention.
Figure 2:
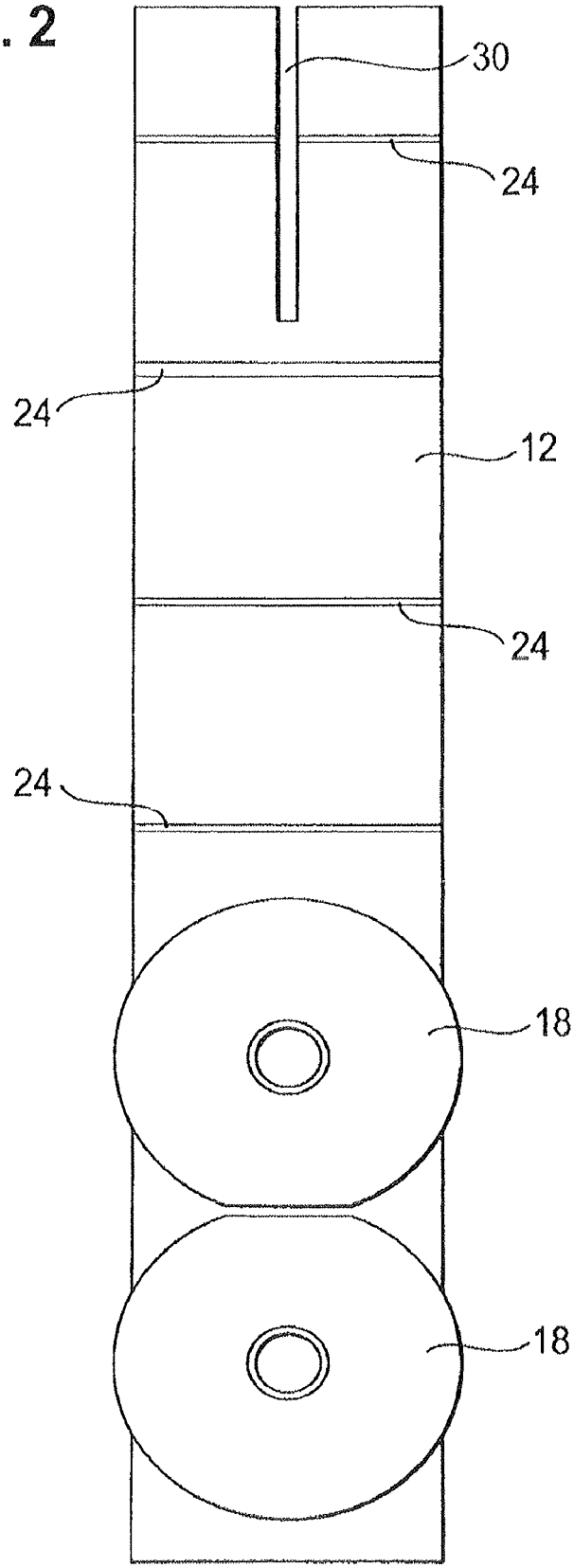
FIG. 2 is a plan view of the preferred embodiment of contact spring according to the invention which is shown in FIG. 1.

In describing the preferred embodiment of the present invention, reference will be made herein to FIGS. 1-6 of the drawings in which like numerals refer to like features of the invention.

In a contact spring of the above-mentioned kind, provision is made in accordance with the invention for the metal contact-spring lamellae to be spaced apart from one another by the thickness of the spacer elements in the resilient region and for at least one of the metal contact-spring lamellae to have at least one slot starting from the free contacting end.

This has the advantage that the contact spring available is one which is able to flex in resiliently in a direction parallel to a longitudinal axis which the metal contact-spring lamellae and the spacer elements have in the clamped region, with all the metal contact-spring lamellae being able to flex in resiliently simultaneously and independently of one another due to the spacing between the metal contact-spring lamellae in the resilient region. In this way, there are at least a number of points or spots of contact between the free contacting end of the contact spring and the contact surface which corresponds to the number of metal contact-spring lamellae, even if the contact surface is uneven. The advantage is also obtained that one, or a plurality in parallel, of electrical contacts of good quality can be made repeatedly (large numbers of cycles of 10,000 to 20,000 or more) with contact surfaces which are uneven and/or yielding, on printed circuit boards for example.

In a preferred embodiment, the common plane of the free contacting end is arranged to be perpendicular to a longitudinal axis which the metal contact-spring lamellae and the spacer elements have in the clamped region.

The metal contact-spring lamellae usefully have two, three or four bends in the resilient region.

By giving all of the metal contact-spring lamellae at least one slot in the resilient region, starting from the free contacting end, there are produced adjacent to the slot contact tongues which flex resiliently independently of one another and the contact members which flex freely and resiliently at the free contacting end are multiplied, and the points of contact are thus multiplied in the same way. The at least one slot extends beyond at least one bend in the metal contact-spring lamellae in this case and preferably extends parallel to a longitudinal axis of the metal contact-spring lamellae.

The metal contact-spring lamellae and the spacer elements are for example riveted and/or screwed together in the clamped region.

The spacer elements usefully extend for part of the clamped region or the entire length of the clamped region.

In a preferred embodiment, the predetermined angle between the longitudinal axis which the metal contact-spring lamellae have upstream of the bend and the longitudinal axis which the metal contact-spring lamellae have downstream of the bend is the same for all the bends.

A substantially zigzag form for the resilient region is achieved by, starting from the clamped region and looking in the direction of the contacting end, making the predetermined angle between the longitudinal axis which the metal contact-spring lamellae have upstream of the bend and the longitudinal axis which the metal contact-spring lamellae have downstream of the bend more than 90° for a first bend and equal to or less than 90° for each further bend in the resilient region.

The sum of the angles 28 of two successive bends 24 is usefully equal to or more than 180°.

The preferred embodiment of contact spring according to the invention which is shown in FIGS. 1 to 4 comprises a free contacting end 10 for making electrical contact with a more or less even contact surface (not shown). The contact spring is formed by N=11 metal contact-spring lamellae 12 and N−1=10 spacer elements 14. The metal contact-spring lamellae 12 are held fixed in a clamped region 16 with one spacer element 14 between each two adjacent metal contact-spring lamellae 12. For this purpose, a stack or set of metal contact-spring lamellae 12 and spacer elements 14 placed alternately one on top of the other are riveted together by means of rivets 18. The spacer elements 14 only extend across the clamped region 16. The metal contact-spring lamellae 12 extend beyond the clamped region 16 and form, between the clamped region 16 and the contacting end 10, a resilient region 20. In this resilient region 20 the metal contact-spring lamellae 12 are spaced apart from one another by the thickness of the spacer elements 14 and thus flex freely, resiliently and independently of one another provided they do not butt against one another due to the resilient travel. The metal contact-spring lamellae 12 are also so formed that they extend parallel to one another for the full length of the resilient region 20 between the contacting end 10 and the clamped region 16. At the free contacting end 10, the metal contact-spring lamellae 12 end in a common plane which is aligned perpendicularly to a longitudinal axis 22 which the metal contact-spring lamellae 12 have in the clamped region 16.

Figure 3:
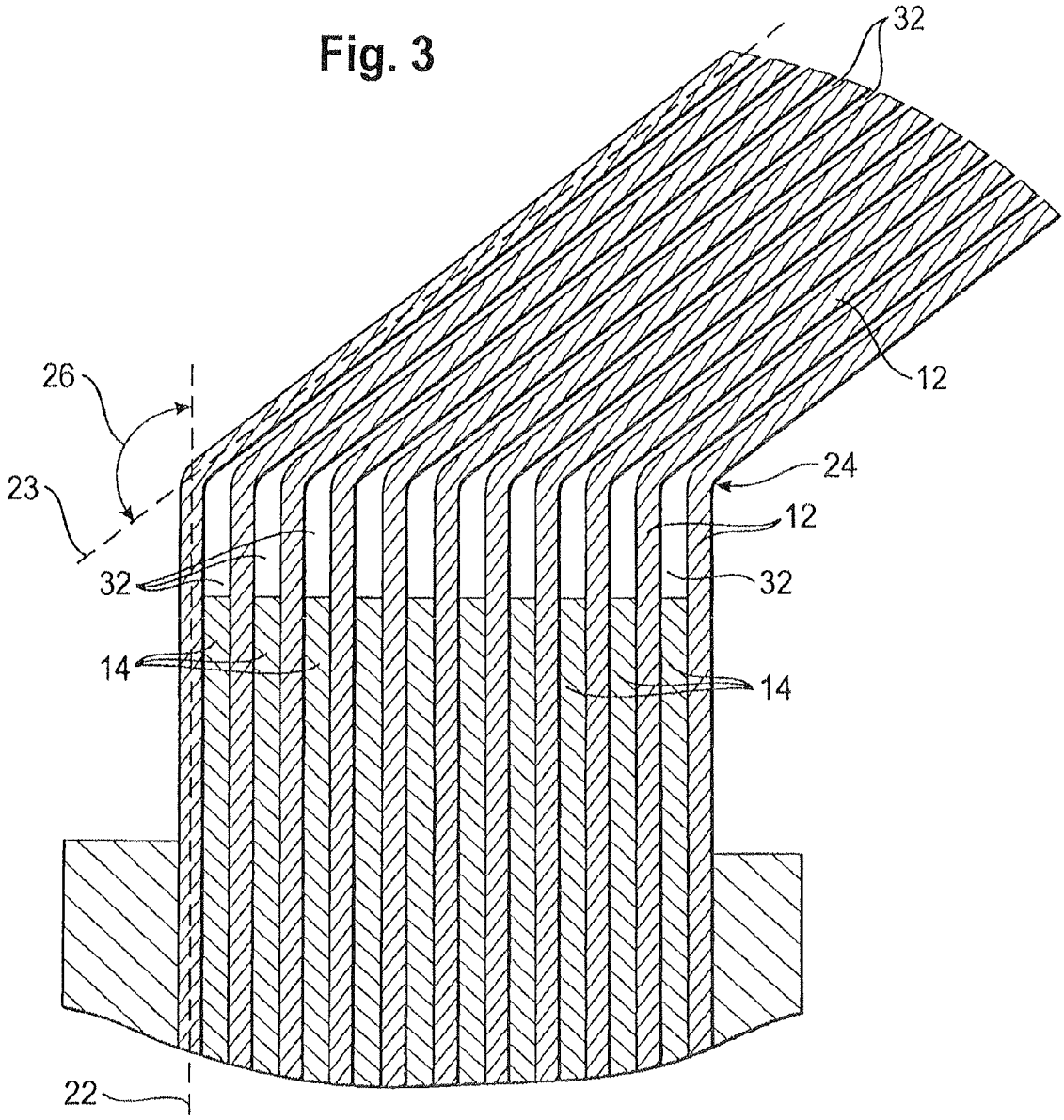
FIG. 3 is an enlarged view of detail B in FIG. 1.
Figure 4:
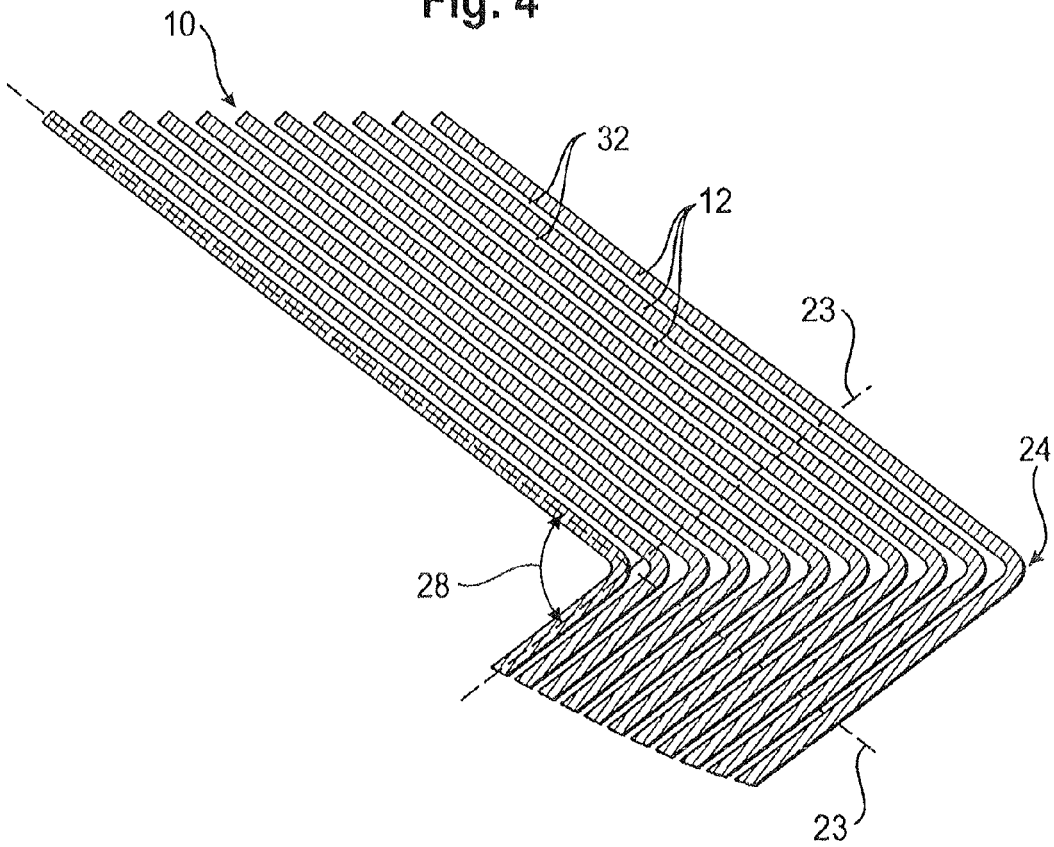
FIG. 4 is an enlarged view of detail A in FIG. 1.

In the resilient region 20, the space between the metal contact-spring lamellae 12 is empty, i.e. a spacer element 14 is not provided there, as can be seen in particular from FIGS. 3 and 4. This free space allows the contact spring to flex in resiliently in the direction of the longitudinal axis 22.

In accordance with the invention, the metal contact-spring lamellae 12 have, in the resilient region 20, at least one bend 24 at each of which there is a predetermined angle 26, 28 between the longitudinal axis 22 or 23 which the metal contact-spring lamellae 12 have upstream of the bend 24 and the longitudinal axis 23 which the metal contact-spring lamellae 12 have downstream of the bend 24. All the longitudinal axes downstream of a bend 24 are identified by the reference numeral 23 in this case. Between two longitudinal axes 23, what is meant by the term "angle" is whichever of the two complementary angles is smaller at a bend 24, as shown in FIGS. 3 and 4.

Starting from the contacting end 10, the metal contact-spring lamellae 12 are each provided with a slot 30. The resilient travel of the contact spring according to the invention is set by the thickness of the spacer elements 14. The constant of the spring is set by the thickness and width of the metal contact-spring lamellae 12 and by the number of metal contact-spring lamellae 12. The number N=11 of metal contact-spring lamellae 12 which are shown in the embodiment is merely illustrative. A number N smaller or larger than 11 is also possible and in particular 2, 3, 4, 5, 6, 7, 8, 9, 10, 12, 13, 14, 15, 16, 17, 18, 19, 20.

The high-current contact spring according to the invention is characterized by a very low contact resistance if the cross-section of the material is sufficiently large and by a low spring constant. The contact spring is preferably suitable for meeting (making contact with) plane surfaces such for example as pads or contact surfaces of printed circuit boards.

The contact spring which is shown by way of example in the drawings has eleven metal contact-spring lamellae 12 and ten spacer elements or metal inserts 14. Because of the central slot 30, the left and right halves of the contact spring which are produced by the slot 30 are able to flex resiliently independently of one another. Because of this, both halves of a spring make secure contact with the contact surface. However, the contact spring still remains stable in the lateral direction. Two, three, or more slots 30 may be provided to suit the application, which produces a corresponding tripling, quadrupling or in other words multiplication of the halves of the contact spring which flex resiliently independently of one another.

By the placing in line of a plurality of thin contact springs it is possible to obtain low forces for resilient flexing and a large resilient travel even when the cross-section of the material is large. The spacer elements or metal inserts 14 provide the mobility required at the time of flexing in by ensuring that there is a sufficiently large gap 32 between the metal contact-spring lamellae 12.

The many independently flexing points of contact form the basis for a low contact resistance, because the contact-making pressure is consistently high at each point of contact.

The contact spring according to the invention comprises a block of metal contact-spring lamellae or individual springs 12 which are curved in an S-shape, with the resiliently flexing geometry being the same for all the metal contact-spring lamellae or individual springs 12 in the block. It is however possible for individual metal contact-spring lamellae 12 also to have additions to their cross-section (attachments). There is obtained, in an advantageous way, a low contact resistance, a contact which is stiff in bending perpendicularly to the plane of operation and contact-making and a soft spring the cross-section of whose material is large and whose overall dimensions are compact. The spring constant is determined in essence by the thickness of the material and the number of metal contact-spring lamellae or individual springs 12.

Figure 5:
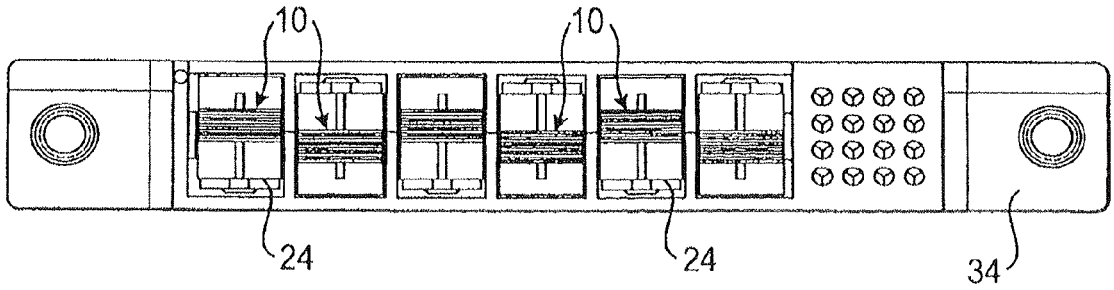
FIG. 5 is a view from below of a contact-making member having a plurality of contact springs according to the invention.
Figure 6:
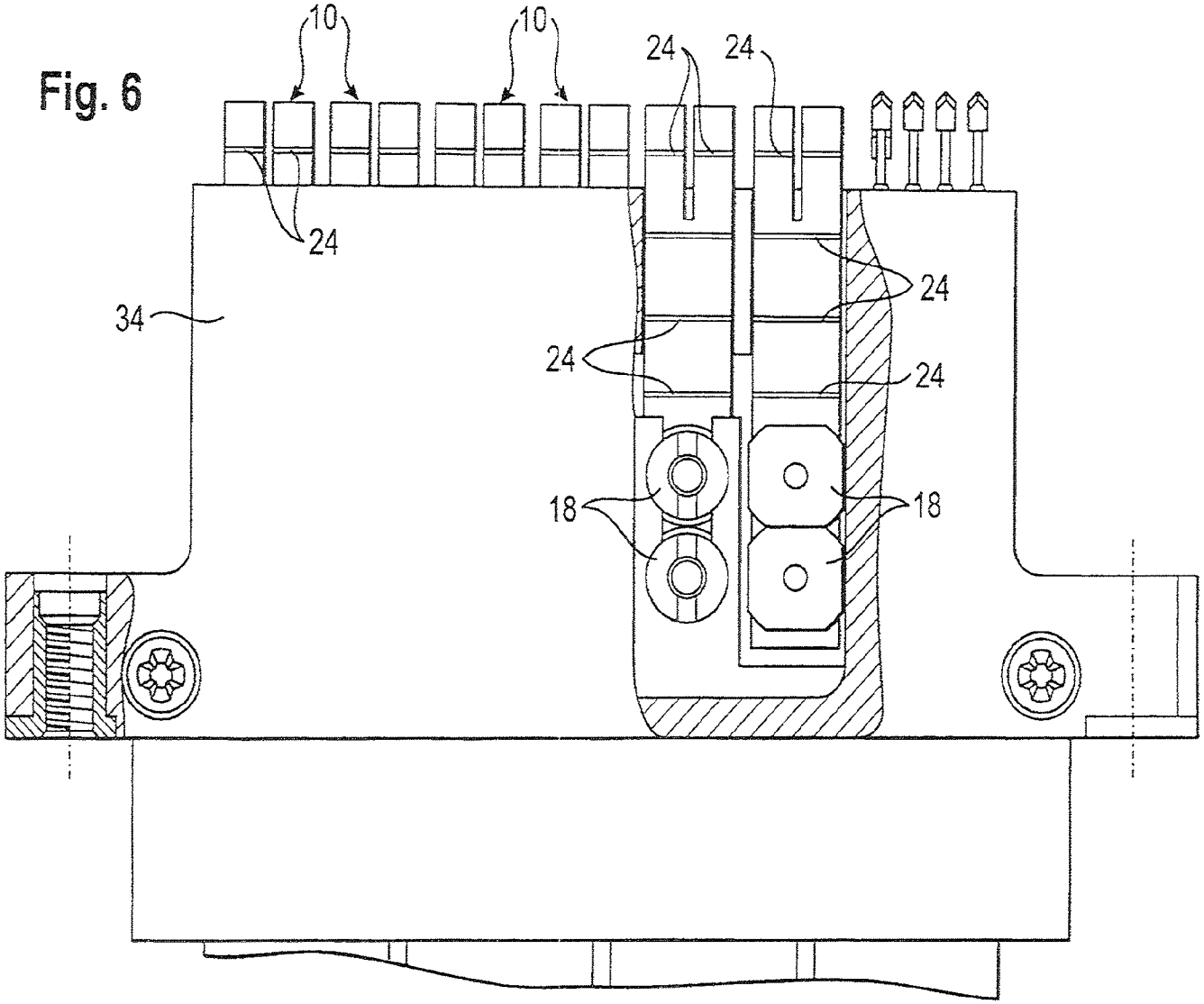
FIG. 6 is a partly cut-away view from the side of the contact-making member shown in FIG. 5.

FIGS. 5 and 6 show a contact-making member 34 which has a plurality of contact springs according to the invention to enable a plurality of mutually separate electrical contacts to be made in parallel.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact spring having a free contacting end for making electric contact between said free contacting end and a contact surface, the contact spring comprising N metal contact-spring lamellae and N−1 spacer elements where N≧2, the metal contact-spring lamellae being held fixed in a clamped region with one spacer element between each two adjacent metal contact-spring lamellae, being spaced apart from one another in a resilient region, extending parallel to one another in a freely and resiliently flexing manner to the free contacting end, and ending in a common plane at the free contacting end, the metal contact-spring lamellae including in the resilient region at least one bend at each of which there is a predetermined angle between an upstream longitudinal axis which the metal contact-spring lamellae have upstream of the bend and a downstream longitudinal axis which the metal contact-spring lamellae have downstream of the bend, said metal contact-spring lamellae spaced apart from one another by the thickness of the spacer elements in the resilient region and at least one of the metal contact-spring lamellae including at least one slot starting from the free contacting end.

2. The contact spring of claim 1 including having the common plane of the free contacting end arranged to be perpendicular to the upstream longitudinal axis which the metal contact-spring lamellae and the spacer elements have in the clamped region.

3. The contact spring of claim 1 wherein the metal contact-spring lamellae includes two, three, or four bends in the resilient region.

4. The contact spring of claim 1, wherein, starting from the free contacting end, all of the metal contact-spring lamellae include at least one slot.

5. The contact spring of claim 1, wherein the at least one slot includes extending beyond the at least one bend in the metal contact-spring lamellae.

6. The contact spring according of claim 1, including having the at least one slot extend parallel to a longitudinal axis which the metal contact-spring lamellae have in the resilient region.

7. The contact spring of claim 1, including having the metal contact-spring lamellae and the spacer elements riveted together, screwed together, or both riveted and screwed together in the clamped region.

8. The contact spring of claim 1, including having the spacer elements extend for part of the clamped region or the entire length of the clamped region.

9. The contact spring of claim 1, including having the predetermined angle between the longitudinal axis which the metal contact-spring lamellae have upstream of the bend and the longitudinal axis which the metal contact-spring lamellae have downstream of the bend the same for all the bends.

10. The contact spring of claim 1, including starting from the clamped region and looking in the direction of the contacting end, the predetermined angle between the longitudinal axis which the metal contact-spring lamellae have upstream of the bend and the longitudinal axis which the metal contact-spring lamellae have downstream of the bend is more than 90° for a first bend and equal to or less than 90° for each further bend in the resilient region.

11. The contact spring of claim 1, including having the sum of the angles of two successive bends equal to or more than 180°.

12. The contact spring of claim 2 wherein the metal contact-spring lamellae includes two, three, or four bends in the resilient region.

13. The contact spring of claim 2, wherein, starting from the free contacting end, all of the metal contact-spring lamellae include at least one slot.

14. The contact spring of claim 3, wherein, starting from the free contacting end, all of the metal contact-spring lamellae include at least one slot.

15. The contact spring of claim 4, wherein the at least one slot includes extending beyond the at least one bend in the metal contact-spring lamellae.

16. The contact spring of claim 14, wherein the at least one slot includes extending beyond the at least one bend in the metal contact-spring lamellae.

17. The contact spring according of claim 5, including having the at least one slot extend parallel to a longitudinal axis which the metal contact-spring lamellae have in the resilient region.

18. The contact spring of claim 17, including having the metal contact-spring lamellae and the spacer elements riveted together, screwed together, or both riveted and screwed together in the clamped region.

19. The contact spring of claim 18, including having the spacer elements extend for part of the clamped region or the entire length of the clamped region.

20. The contact spring of claim 3, including having the predetermined angle between the longitudinal axis which the metal contact-spring lamellae have upstream of the bend and the longitudinal axis which the metal contact-spring lamellae have downstream of the bend the same for all the bends.

21. The contact spring of claim 19, including having the predetermined angle between the longitudinal axis which the metal contact-spring lamellae have upstream of the bend and the longitudinal axis which the metal contact-spring lamellae have downstream of the bend the same for all the bends.

22. The contact spring of claim 3, including starting from the clamped region and looking in the direction of the contacting end, the predetermined angle between the longitudinal axis which the metal contact-spring lamellae have upstream of the bend and the longitudinal axis which the metal contact-spring lamellae have downstream of the bend is more than 90° for a first bend and equal to or less than 90° for each further bend in the resilient region.

23. The contact spring of claim 10, including having the sum of the angles of two successive bends equal to or more than 180°.

24. The contact spring of claim 22, including having the sum of the angles of two successive bends equal to or more than 180°.

* * * * *